US008443967B2

(12) United States Patent
Glass et al.

(10) Patent No.: US 8,443,967 B2
(45) Date of Patent: May 21, 2013

(54) GIFT CARD SLEEVE

(75) Inventors: Brett R. Glass, Overland Park, KS (US); Nicole E. Glass, Overland Park, KS (US)

(73) Assignee: Gift Card Impressions, LLC, Overland Park, KS (US)

( * ) Notice: Subject to any disclaimer, the term of this patent is extended or adjusted under 35 U.S.C. 154(b) by 0 days.

(21) Appl. No.: 13/294,142

(22) Filed: Nov. 10, 2011

(65) Prior Publication Data

US 2012/0285968 A1 Nov. 15, 2012

Related U.S. Application Data

(60) Provisional application No. 61/412,391, filed on Nov. 10, 2010.

(51) Int. Cl.
*A45C 11/18* (2006.01)

(52) U.S. Cl.
USPC ..... 206/39; 40/124.19

(58) Field of Classification Search
USPC ..... 206/449, 555, 454, 39, 39.4, 39.6, 206/39.7, 738, 756, 758; 40/124.06, 124.19
See application file for complete search history.

(56) References Cited

U.S. PATENT DOCUMENTS

| | | | | |
|---|---|---|---|---|
| 2004/0093773 | A1* | 5/2004 | Clark | 40/124.06 |
| 2009/0107862 | A1* | 4/2009 | Pascua et al. | 206/232 |
| 2012/0048766 | A1* | 3/2012 | Glass et al. | 206/484 |
| 2012/0205281 | A1* | 8/2012 | Glass et al. | 206/556 |
| 2012/0241520 | A1* | 9/2012 | Clegg | 235/487 |

* cited by examiner

*Primary Examiner* — Jacob K Ackun
(74) *Attorney, Agent, or Firm* — Polsinelli Shughart PC

(57) ABSTRACT

A gift card holder including a sliding panel for holding a gift card, the panel being mounted in a sleeve or box so that when the cover flap of the sleeve is opened the panel may be pulled upward and out of the sleeve to reveal a gift card secured upon the panel.

1 Claim, 4 Drawing Sheets

GIFT CARD SLEEVE

CROSS REFERENCE TO RELATED APPLICATIONS

This application claims the benefit of the prior filed, provisional application Ser. No. 61/412,391, filed Nov. 10, 2010.

BACKGROUND OF THE INVENTION

This invention relates generally to gift card holders and more particularly to a device for holding a gift card or gift card packet while providing graphical and mechanical enhancements to entertain the gift card recipient and add value to the gift, namely a sliding panel for holding a gift card, the panel being mounted in a sleeve or box so that when the cover flap is opened the panel may be pulled upward and out of the sleeve to reveal a gift card secured upon the panel.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift.

BRIEF DESCRIPTION OF THE INVENTION

The purpose of this invention is to provide a holder for receiving and holding a gift card. The gift card holder provides graphical and mechanical enhancements to entertain the gift card recipient and add value to the gift. The gift card holder presents a gift card mounted on a sliding panel that rides upon slots or tracks enclosed in a sleeve or box that houses the panel. For presentation to the gift recipient, the user pulls on a ribbon or pull tab mounted proximate the top edge of the panel, thereby drawing the panel out of the sleeve to a predetermined stop. The gift card may then be removed from a pocket in the panel. When the panel is housed within the sleeve, a cover flap is folded over the top of the sleeve to secure the panel in place.

An embodiment of the holder may include a sliding panel held within a sleeve, the panel including means to attach a card, such as a pocket. The sleeve includes a cover that, when closed, operates to retain the panel within the sleeve. Closure of the cover may be maintained and the cover restrained from opening by cooperating hook and loop structures on the interior surface of the cover and on an underlying outer portion of the sleeve. A tab projecting from the panel passes into or insert into a slot within the sleeve. Preferably two tabs insert into two parallel slots so that the tabs ride within the slots when the panel is withdrawn from or retracted into the sleeve. A pull tab projects from an upper portion of the panel to provide a structure for the user to grasp to pull the panel from the sleeve.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
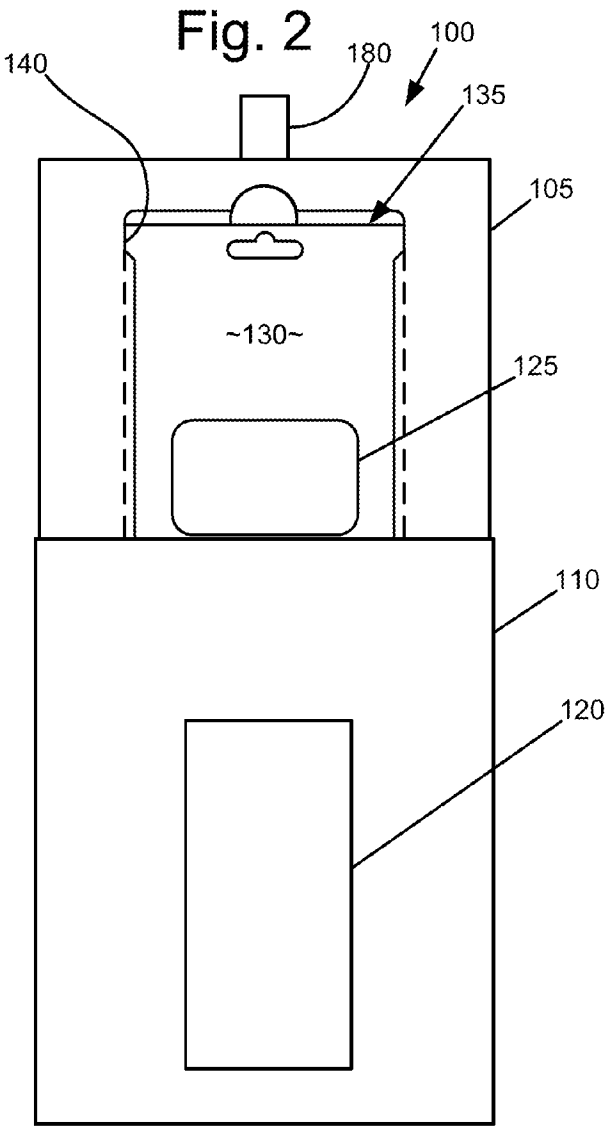
FIG. 2 is a front view of the gift card sleeve showing the sliding panel drawn upward from the sleeve.
Figure 1:
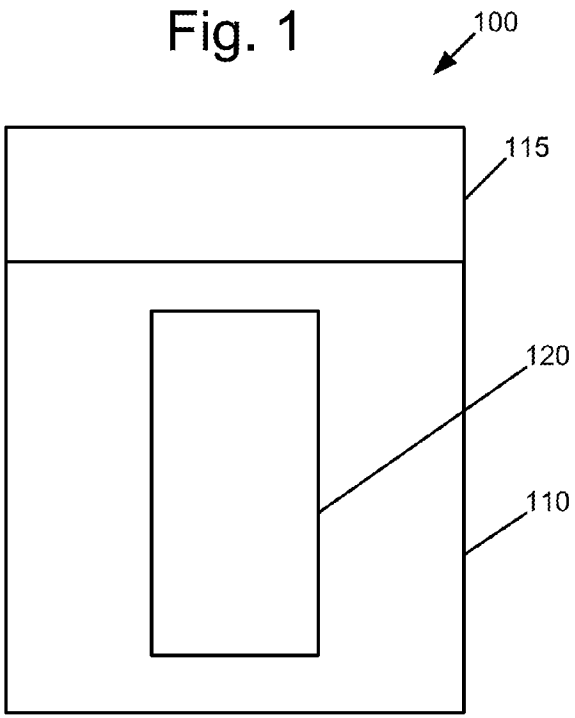
FIG. 1 is a front view of a gift card sleeve with the cover flap closed.

With reference to the figures, FIGS. 1 through 8 illustrate embodiments of a gift card holder 100 comprising a sliding panel 105 and a sleeve 110. FIG. 1 is a front view of a holder 100 with the cover flap 115 closed upon the front surface of the sleeve 110. The sleeve 110 and other elements may bear graphics or other indicia or decorations 120. FIG. 2 is a front view of the holder 100 showing the sliding panel 105 drawn upward from the sleeve 110 to reveal a gift card 125. The gift card 125 is mounted on a backer card 130, as known in the prior art. The backer card 130 and gift card 125 may comprise a packet 135. As shown, the packet 135 is housed within the sliding panel pocket 140.

Figure 4:
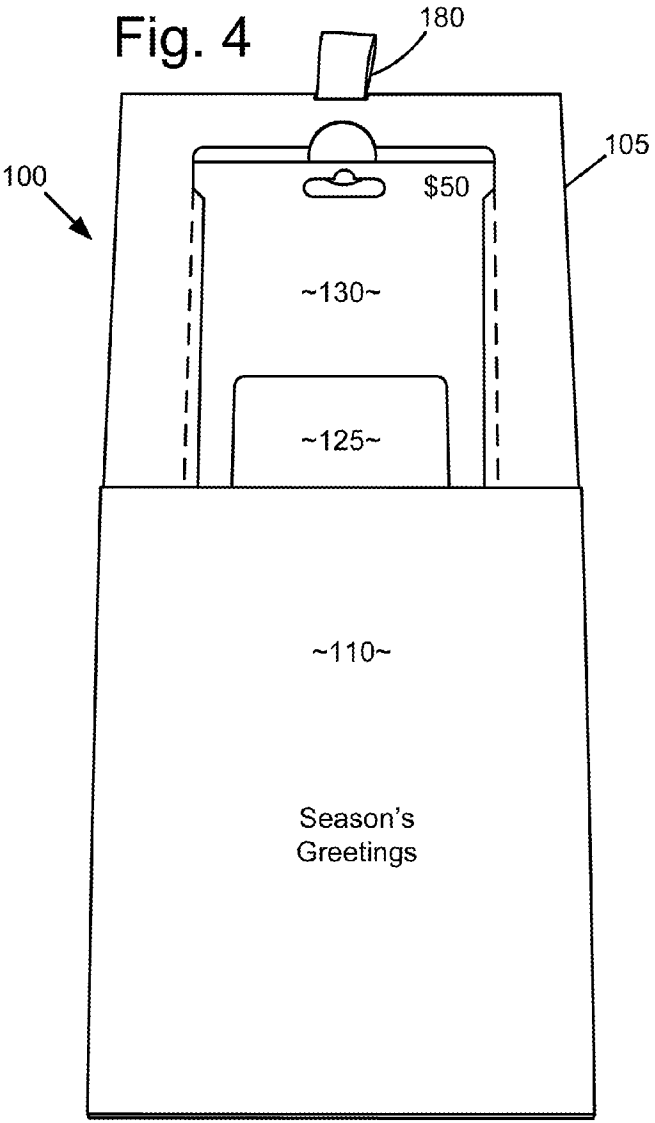
FIG. 4 is an additional front view of the gift card sleeve showing the sliding panel drawn upward from the sleeve.
Figure 3:
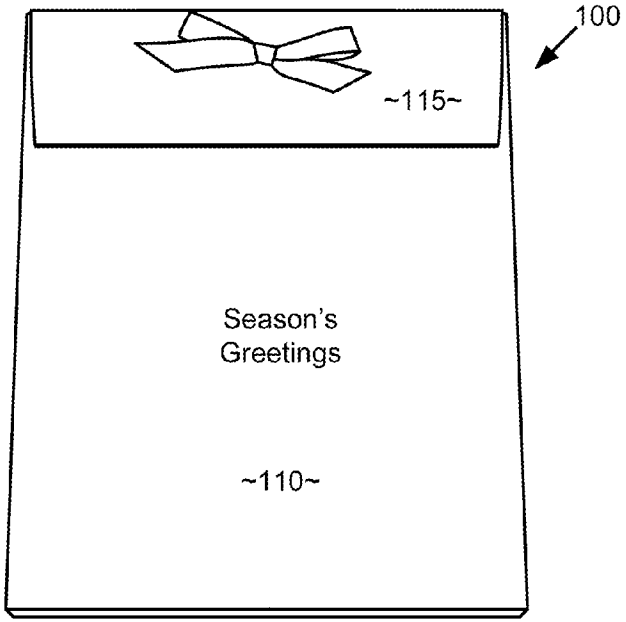
FIG. 3 is an additional front view of a gift card sleeve with the cover flap closed.

FIG. 3 is an additional front view of a holder 100 with the cover flap 115 closed. FIG. 4 is an additional front view of the holder 100 showing the sliding panel 105 drawn upward from the sleeve 110.

Figure 5:
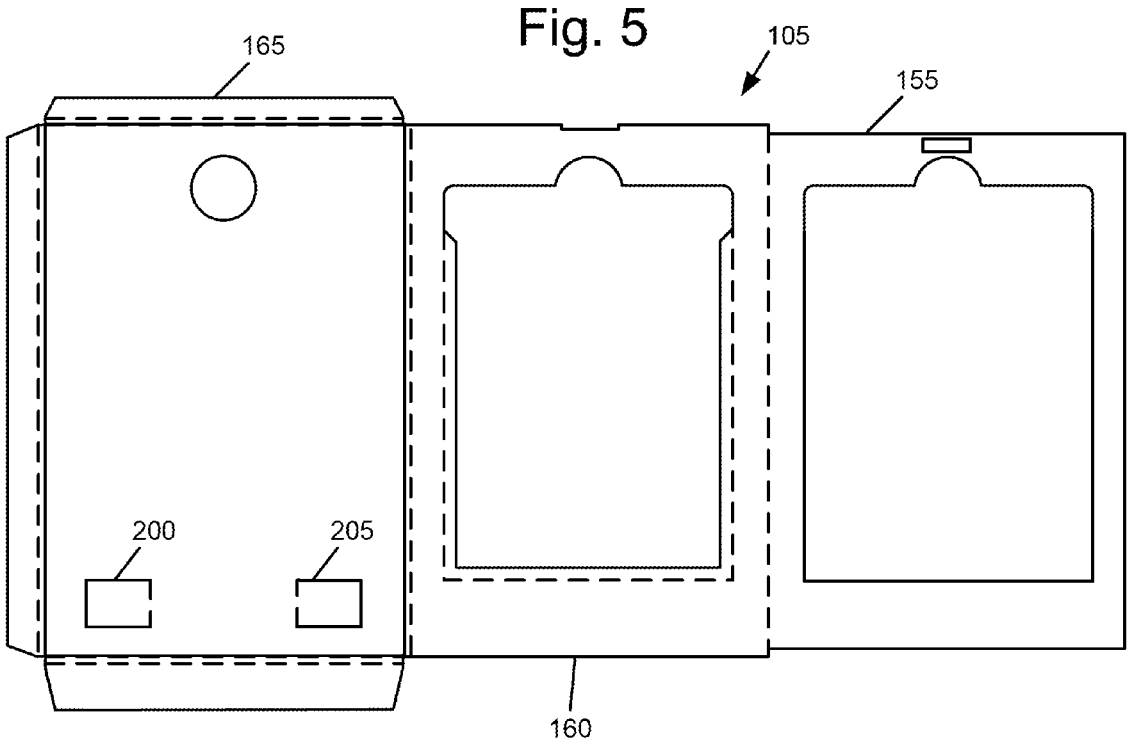
FIG. 5 is a plan view of a cardstock sheet that may be folded to form a sliding panel.

FIG. 5 is a plan view of a cardstock sheet that may be folded to form a sliding panel 105. The panel 105 is formed of three sheets folded in upon each other. Sheet 155 forms an inner frame that supports the edges of a gift card packet 135 when such is mounted within the pocket 140. During assembly, sheet 155 is folded upon sheet 160. The insert sheet 170 is adhered to the slider core 175 and both are attached to sheet 165. Sheet 160 and 155 are then folded upon sheet 165 and the slider core assembly.

Figure 6:
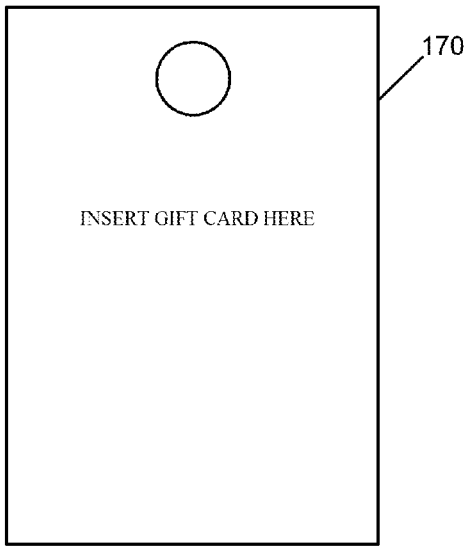
FIG. 6 is an insert sheet that is attached to cover a slider core.
Figure 7:
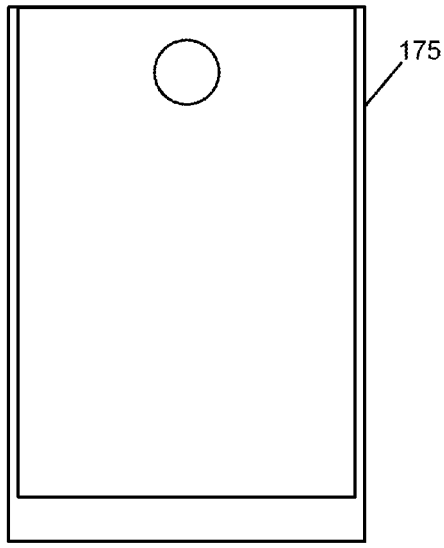
FIG. 7 is a slider core.

FIG. 6 is an insert sheet 170 that is attached to cover a slider core 175.

Figure 8:
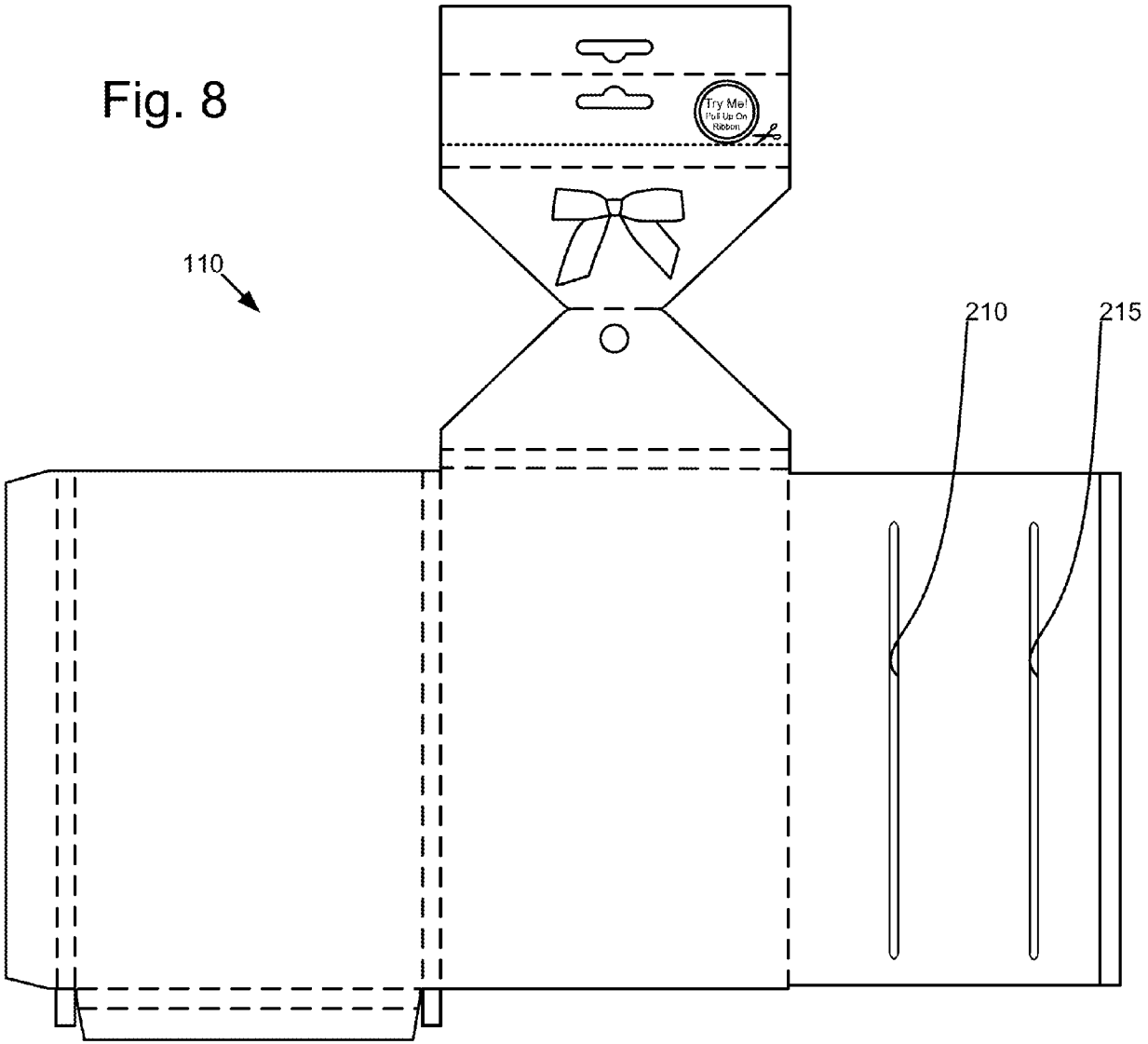
FIG. 8 is a plan view of a cardstock sheet that may be folded to form a sleeve.

FIG. 8 is a plan view of a cardstock sheet that may be folded to form a sleeve 110. After assembly of the sliding panel, the tabs of sheet 165 are bent outward and passed into slots 210 and 215 in the sleeve where they provide some stability to the sliding panel and also act to limit travel, particularly upward travel, of the panel by providing a positive stop when a tab comes to abut the upper edge of a slot 210 or 215.

For presentation of a gift card 125 to the gift recipient, the user pulls on a ribbon or pull tab 180 mounted proximate the top edge 185 of the panel 105, thereby drawing the panel 105 out of the sleeve 110 to a predetermined stop. The gift card 125 may then be removed from a pocket 140 in the panel 105. When the panel 105 is housed within the sleeve 110, a cover flap 115 is folded over the top of the sleeve 110 to secure the panel 105 in place within the sleeve 110.

Note that drawings are not to scale or to relative scale but are representative of aspects of one or more embodiments of the present invention.

Having thus described the invention, what is claimed as new and desired to be secured by Letters Patent is:

1. A gift card holder comprising:

a sliding panel held within a sleeve, said panel including means to attach a card, said sleeve including a cover projecting from an upper margin thereof that when closed operates to retain said panel within said sleeve, a tab projecting from said panel to pass into a slot within said sleeve, whereby said tab rides within said slot when said panel is withdrawn from or retracted into said sleeve, and a pull tab projecting from an upper portion of said panel, said pull tab providing a structure for grasping by a user to pull said panel from said sleeve.

* * * * *